US007579067B2

(12) United States Patent
Lin et al.

(10) Patent No.: US 7,579,067 B2
(45) Date of Patent: Aug. 25, 2009

(54) PROCESS CHAMBER COMPONENT WITH LAYERED COATING AND METHOD

(75) Inventors: Yixing Lin, Saratoga, CA (US); Dajiang Xu, Milpitas, CA (US); Clifford Stow, Boulder Creek, CA (US)

(73) Assignee: Applied Materials, Inc., Santa Clara, CA (US)

( * ) Notice: Subject to any disclaimer, the term of this patent is extended or adjusted under 35 U.S.C. 154(b) by 259 days.

(21) Appl. No.: 10/996,883

(22) Filed: Nov. 24, 2004

(65) Prior Publication Data

US 2006/0110620 A1 May 25, 2006

(51) Int. Cl.

| | |
|---|---|
| ***B32B 5/32*** | (2006.01) |
| ***B32B 3/02*** | (2006.01) |
| ***B32B 5/18*** | (2006.01) |
| ***C23C 14/00*** | (2006.01) |

(52) U.S. Cl. ..... 428/220; 428/212; 428/218; 428/316.6; 428/318.4; 118/723 R; 204/298.01

(58) Field of Classification Search ..... None
See application file for complete search history.

(56) References Cited

U.S. PATENT DOCUMENTS

| | | | |
|---|---|---|---|
| 2,705,500 | A | 4/1955 | Deer |
| 3,117,883 | A | 1/1964 | Pierett |
| 3,457,151 | A | 7/1969 | Kortejarvi |
| 3,522,083 | A | 7/1970 | Woolman |
| 3,565,771 | A | 2/1971 | Gulla |
| 3,679,460 | A | 7/1972 | Reid |
| 4,100,252 | A | 7/1978 | Pitts |
| RE31,198 | E | 4/1983 | Binns |
| 4,419,201 | A | 12/1983 | Levinstein et al. |
| 4,491,496 | A | 1/1985 | Laporte et al. |
| 4,673,554 | A | 6/1987 | Niwa et al. |
| 4,713,119 | A | 12/1987 | Earhart et al. |
| 4,717,462 | A | 1/1988 | Homma et al. |

(Continued)

FOREIGN PATENT DOCUMENTS

| | | | |
|---|---|---|---|
| DE | 19719133 | A1 | 11/1998 |

(Continued)

OTHER PUBLICATIONS

Rosenberg, RW, "Increasing PVD Tool Uptime and Particle Control with Twin-Wire-Arc Spray Coatings", Mar. 2001, p. 103-105,108, 11, vol. 19, No. 3, Cannon Comm., Santa Monica, CA.

(Continued)

*Primary Examiner*—Jennifer Mcneil
*Assistant Examiner*—Jason L Savage
(74) *Attorney, Agent, or Firm*—Janah & Associates, P.C.

(57) ABSTRACT

A substrate processing chamber component is capable of being exposed to an energized gas in a process chamber. The component has an underlying structure and first and second coating layers. The first coating layer is formed over the underlying structure, and has a first surface with an average surface roughness of less than about 25 micrometers. The second coating layer is formed over the first coating layer, and has a second surface with an average surface roughness of at least about 50 micrometers. Process residues can adhere to the surface of the second coating layer to reduce the contamination of processed substrates.

33 Claims, 3 Drawing Sheets

U.S. PATENT DOCUMENTS

| | | | |
|---|---|---|---|
| 4,732,792 | A | 3/1988 | Fujiyama |
| 4,756,322 | A | 7/1988 | Lami |
| 4,959,105 | A | 9/1990 | Neidiffer et al. |
| 5,009,966 | A | 4/1991 | Garg et al. |
| 5,032,469 | A | 7/1991 | Merz et al. |
| 5,064,511 | A | 11/1991 | Gobbetti |
| 5,104,501 | A | 4/1992 | Okabayashi |
| 5,164,016 | A | 11/1992 | Henriet et al. |
| 5,180,322 | A | 1/1993 | Yamamoto et al. |
| 5,180,563 | A | 1/1993 | Lai et al. |
| 5,202,008 | A | 4/1993 | Talieh et al. |
| 5,215,624 | A | 6/1993 | Dastolfo et al. |
| 5,248,386 | A | 9/1993 | Dastolfo et al. |
| 5,338,367 | A | 8/1994 | Henriet et al. |
| 5,356,723 | A | 10/1994 | Kimoto et al. |
| 5,366,585 | A | 11/1994 | Robertson et al. |
| 5,391,275 | A | 2/1995 | Mintz |
| 5,401,319 | A | 3/1995 | Banholzer et al. |
| 5,474,649 | A | 12/1995 | Kava et al. |
| 5,509,558 | A | 4/1996 | Imai et al. |
| 5,520,740 | A | 5/1996 | Kanai et al. |
| 5,549,802 | A | 8/1996 | Guo |
| 5,587,039 | A | 12/1996 | Salimian et al. |
| 5,660,640 | A | 8/1997 | Laube |
| 5,714,010 | A | 2/1998 | Matsuyama et al. |
| 5,762,748 | A | 6/1998 | Banholzer et al. |
| 5,808,270 | A | 9/1998 | Marantz et al. |
| 5,840,434 | A | 11/1998 | Kojima et al. |
| 5,858,100 | A | 1/1999 | Maeda et al. |
| 5,879,523 | A | 3/1999 | Wang et al. |
| 5,903,428 | A | 5/1999 | Grimard et al. |
| 5,910,338 | A | 6/1999 | Donde |
| 5,916,378 | A | 6/1999 | Bailey et al. |
| 5,916,454 | A | 6/1999 | Richardson et al. |
| 5,939,146 | A | 8/1999 | Lavernia |
| 5,953,827 | A | 9/1999 | Or et al. |
| 5,967,047 | A | 10/1999 | Kuhn et al. |
| 5,976,327 | A | 11/1999 | Tanaka |
| 6,015,465 | A | 1/2000 | Kholodenko et al. |
| 6,051,114 | A | 4/2000 | Yao et al. |
| 6,059,945 | A | 5/2000 | Fu et al. |
| 6,120,621 | A | 9/2000 | Jin et al. |
| 6,120,640 | A | 9/2000 | Shih et al. |
| 6,152,071 | A | 11/2000 | Akiyama et al. |
| 6,306,489 | B1 | 10/2001 | Hellmann et al. |
| 6,306,498 | B1 | 10/2001 | Yuuki et al. |
| 6,338,906 | B1 | 1/2002 | Ritland et al. |
| 6,379,575 | B1 | 4/2002 | Yin et al. |
| 6,383,459 | B1 | 5/2002 | Singh et al. |
| 6,394,023 | B1 | 5/2002 | Crocker |
| 6,444,083 | B1 | 9/2002 | Steger et al. |
| 6,454,870 | B1 | 9/2002 | Brooks |
| 6,555,471 | B2 | 4/2003 | Sandhu et al. |
| 6,565,984 | B1 | 5/2003 | Wu et al. |
| 6,566,161 | B1 | 5/2003 | Rosenberg et al. |
| 6,592,830 | B1 | 7/2003 | Krupin et al. |
| H2087 | H | 11/2003 | Balliett et al. |
| 6,777,045 | B2 | 8/2004 | Lin et al. |
| 6,902,627 | B2 | 6/2005 | Brueckner et al. |
| 6,902,628 | B2 | 6/2005 | Wang et al. |
| 6,933,025 | B2 | 8/2005 | Lin et al. |
| 7,026,009 | B2 | 4/2006 | Lin et al. |
| 2001/0033706 | A1 | 10/2001 | Shimomura et al. |
| 2002/0086118 | A1 | 7/2002 | Chang et al. |
| 2002/0090464 | A1* | 7/2002 | Jiang et al. ..... 427/446 |
| 2003/0026917 | A1 | 2/2003 | Lin et al. |
| 2003/0047464 | A1 | 3/2003 | Sun et al. |
| 2003/0108680 | A1 | 6/2003 | Gell et al. |
| 2003/0116276 | A1* | 6/2003 | Weldon et al. ..... 156/345.1 |
| 2003/0118731 | A1* | 6/2003 | He et al. ..... 427/307 |
| 2003/0136428 | A1 | 7/2003 | Krogh |
| 2003/0170486 | A1 | 9/2003 | Austin et al. |
| 2003/0173526 | A1 | 9/2003 | Popiolkowski et al. |
| 2003/0185965 | A1* | 10/2003 | Lin et al. ..... 427/8 |
| 2003/0196890 | A1* | 10/2003 | Le et al. ..... 204/192.12 |
| 2003/0221702 | A1 | 12/2003 | Peebles |
| 2004/0045574 | A1 | 3/2004 | Tan |
| 2004/0056211 | A1 | 3/2004 | Popiolkowski et al. |
| 2004/0099285 | A1 | 5/2004 | Wang et al. |
| 2004/0163699 | A1* | 8/2004 | Boulanger ..... 136/259 |
| 2004/0180158 | A1 | 9/2004 | Lin et al. |
| 2005/0028838 | A1 | 2/2005 | Brueckner |
| 2005/0048876 | A1 | 3/2005 | West et al. |
| 2005/0089699 | A1* | 4/2005 | Lin et al. ..... 428/457 |
| 2005/0238807 | A1* | 10/2005 | Lin et al. ..... 427/248.1 |
| 2006/0105182 | A1 | 5/2006 | Brueckner et al. |
| 2006/0251822 | A1 | 11/2006 | Gell et al. |

FOREIGN PATENT DOCUMENTS

| | | | |
|---|---|---|---|
| EP | 0239349 | | 7/1992 |
| EP | 0838838 | A2 | 4/1998 |
| EP | 0845545 | A1 | 6/1998 |
| EP | 1049133 | A2 | 11/2000 |
| EP | 1158072 | A2 | 11/2001 |
| EP | 1258908 | A2 | 11/2002 |
| FR | 2562097 | A1 | 10/1985 |
| JP | 54162696 | | 12/1979 |
| JP | 54162969 | | 12/1979 |
| JP | 11-59368 | | 12/1987 |
| JP | 63235435 | | 9/1988 |
| JP | 02-101157 | | 4/1990 |
| JP | 03-138354 | | 6/1991 |
| JP | 07197272 | A | 8/1995 |
| JP | 09-272965 | | 10/1997 |
| JP | 10-045461 | | 2/1998 |
| JP | 63149396 | | 6/1998 |
| JP | 10-251871 | | 9/1998 |
| JP | 10-330971 | | 12/1998 |
| JP | 11137440 | A | 5/1999 |
| JP | 11-220164 | | 8/1999 |
| JP | 11-283972 | | 10/1999 |
| JP | 2000-228398 | | 10/1999 |
| JP | 2250990 | | 10/1999 |
| JP | 11-345780 | | 12/1999 |
| JP | 2000-072529 | | 3/2000 |
| JP | 2000-191370 | | 7/2000 |
| JP | 2002069695 | | 3/2002 |
| JP | 2002069696 | | 3/2002 |
| TW | 546680 | | 8/2003 |
| WO | WO-99/17336 | | 4/1999 |
| WO | WO-98/50599 | | 11/1999 |
| WO | WO-02/15255 | | 2/2002 |
| WO | WO-03/083160 | | 10/2003 |

OTHER PUBLICATIONS

International Searching Authority, International Search Report and Written Opinion for International Application No. PCT/US2005/041862, Jun. 22, 2006, Rijswijk.

U.S. Patent Application entitled, "Refurbishment of a Coated Chamber Component"; filed Apr. 27, 2004; U.S. Appl. No. 10/833,975; Inventors: Lin, et al.

* cited by examiner

PROCESS CHAMBER COMPONENT WITH LAYERED COATING AND METHOD

BACKGROUND

The present invention relates to components for a substrate processing chamber.

In the processing of substrates, such as semiconductor wafers and displays, a substrate is placed in a process chamber and exposed to an energized gas to deposit, or etch material on the substrate. During such processing, process residues are generated and can deposit on internal surfaces in the chamber. For example, in sputter deposition processes, material sputtered from a target for deposition on a substrate also deposits on other component surfaces in the chamber, such as on deposition rings, shadow rings, wall liners, and focus rings. In subsequent process cycles, the deposited process residues can "flake off" of the chamber surfaces to fall upon and contaminate the substrate.

To reduce the contamination of the substrates by process residues, the surfaces of components in the chamber can be textured. Process residues adhere better to the exposed textured surface and are inhibited from falling off and contaminating the substrates in the chamber. The textured component surface can be formed by coating a roughened surface of a component, as described for example in U.S. Pat. No. 6,777,045 to Shyh-Nung Lin et al, issued on Aug. 17, 2004, and commonly assigned to Applied Materials, and U.S. application Ser. No. 10/833,975 to Lin et al, filed on Apr. 27, 2004, and commonly assigned to Applied Materials, both of which are herein incorporated by reference in their entireties. Coatings having a higher surface roughness can be better capable of accumulating and retaining process residues during substrate processing, to reduce the contamination of the substrates processed in the chamber.

However, the extent of the surface roughness provided on the coatings can be limited by the bonding properties of the coating to the underlying component structure. For example, a dilemma posed by current processes is that coatings having an increased surface roughness, and thus improved adhesion of process residues, also are typically less strongly bonded to the underlying structure. This may be especially true for coatings on components having a dissimilar composition, such as for example aluminum coatings on ceramic or stainless steel components. Processing of substrates with the less strongly adhered coating can result in delamination, cracking, and flaking-off of the coating from the underlying structure. The plasma in the chamber can penetrate through damaged areas of the coating to erode the exposed surfaces of the underlying structure, eventually leading to failure of the component. Thus, the coated components typically do not provide both adequate bonding and good residue adhesion characteristics.

Thus, it is desirable to have a coated component and method that provide improved adhesion of process residues to the surface of the component, substantially without de-lamination of the coating from the component. It is further desirable to have a coated component and method that provide a well-bonded coating having an increased surface roughness to improve the adhesion of process residues.

SUMMARY

In one version, a substrate processing chamber component capable of being exposed to an energized gas in a process chamber has an underlying structure and first and second coating layers. The first coating layer is formed over the underlying structure, and has a first surface with an average surface roughness of less than about 25 micrometers. The second coating layer is formed over the first coating layer, and has a second surface with an average surface roughness of at least about 50 micrometers. Process residues can adhere to the surface of the second coating layer to reduce the contamination of processed substrates.

In another version, the substrate processing chamber component has an underlying structure of at least one of stainless steel, aluminum and titanium. The component has a first sprayed coating layer of aluminum over the underlying structure, the first sprayed coating layer having (i) a porosity of less than about 10%, and (ii) a first surface with an average surface roughness of less than about 25 micrometers. The component also has a second sprayed coating layer of aluminum over the first sprayed coating layer, the second sprayed coating layer having (i) a porosity of at least about 12%, and (ii) a second surface with an average surface roughness of at least about 50 micrometers. Process residues adhere to the second surface to reduce the contamination of processed substrates.

In one version, a method of manufacturing the substrate processing chamber component includes providing an underlying structure and spraying a first coating layer onto the underlying structure. First spraying parameters are maintained to form a first surface on the first coating layer that has average surface roughness of less than about 25 micrometers. A second coating layer is sprayed over the first coating layer while maintaining second spraying parameters to form a second surface on the second coating layer that has an average surface roughness of at least about 50 micrometers.

In another version, a twin wire arc sprayer capable of forming a coating on a structure is provided. The sprayer has first and second electrodes capable of being biased to generate an electrical arc therebetween, at least one of the electrodes having a consumable electrode. The sprayer also has a supply of pressurized gas to direct pressurized gas past the electrodes, and a nozzle through which the pressurized gas is flowed. The nozzle has a conduit to receive the pressurized gas, and a conical section having an inlet that is attached to the conduit and an outlet that releases the pressurized gas. The conical section has sloping conical sidewalls that expand outwards from the inlet to the outlet. The inlet has a first diameter and the outlet has a second diameter, the second diameter being at least about 1.5 times the size of the first diameter, whereby a pressure of the pressurized gas flowing through the nozzle can be selected to provide a predetermined surface roughness average of the coating. The consumable electrode is at least partially melted by the electrical arc to form molten material, and the molten material is propelled by the pressurized gas through the nozzle and onto the structure to form the coating. The nozzle allows a pressure of the pressurized gas to be selected to provide a predetermined surface roughness average of the coating.

DRAWINGS

These features, aspects and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

Figure 3A:
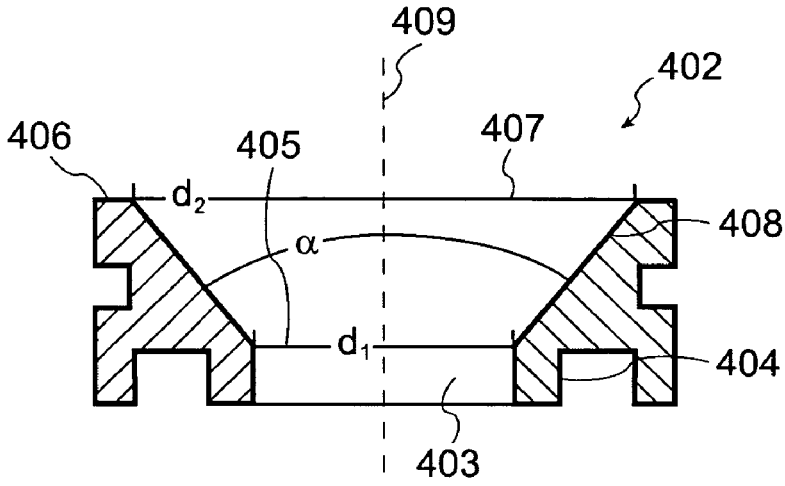
Figure 3B:
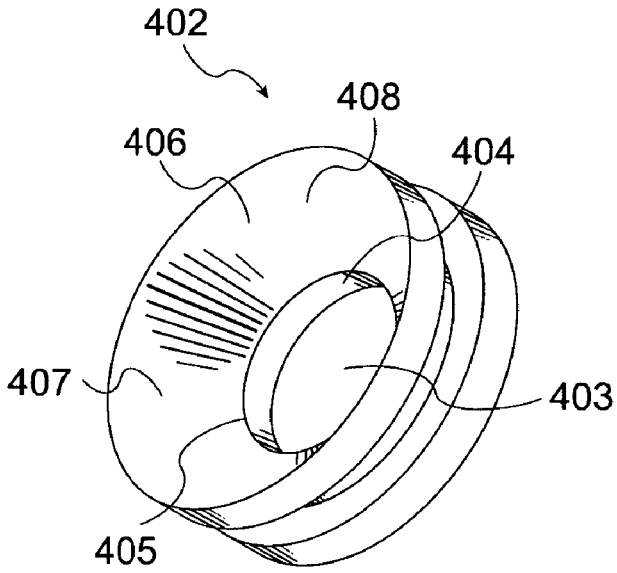
Figure 4:
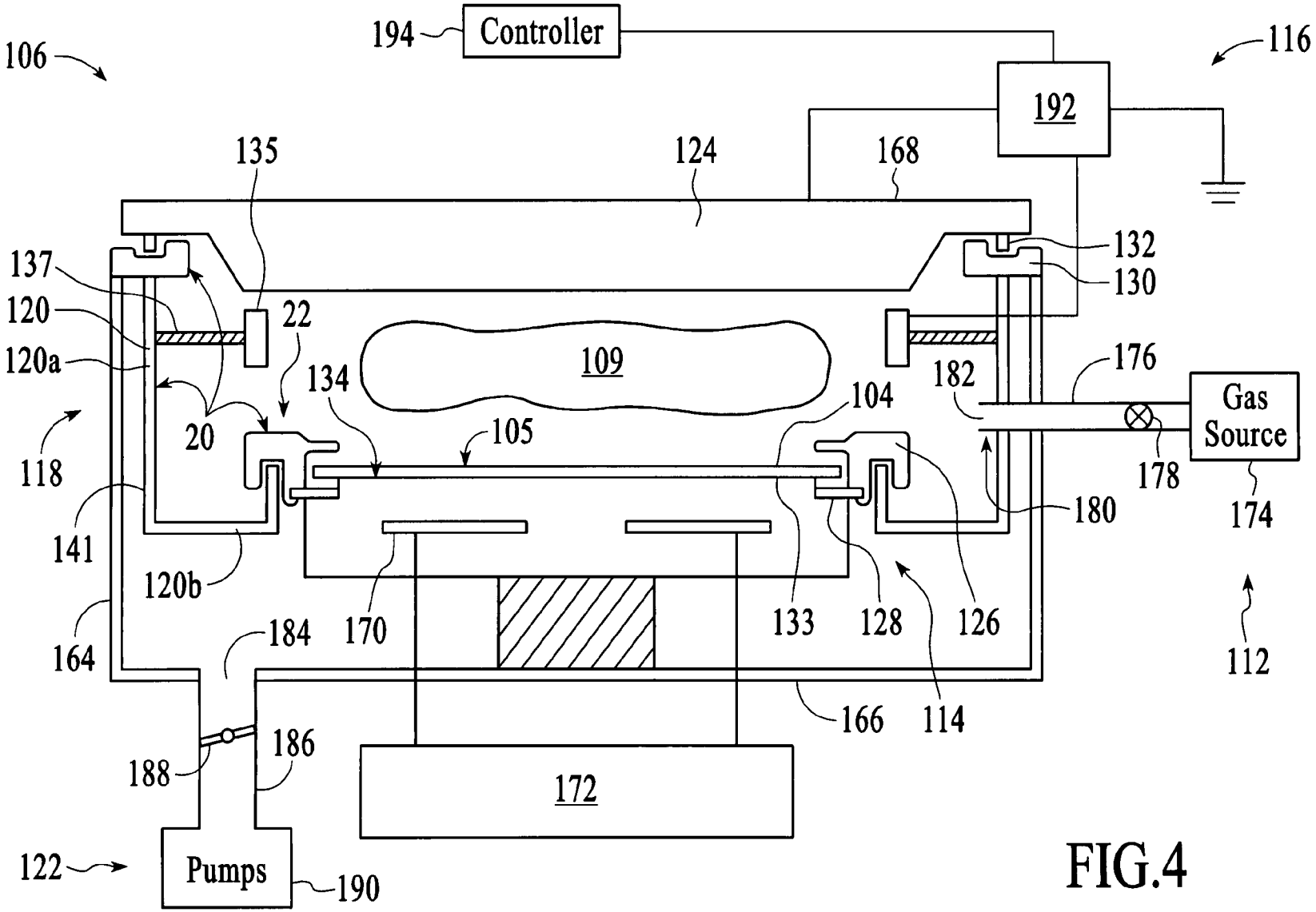

FIGS. 3*a* and 3*b* are a partial sectional side view and an offset top view, respectively, of an embodiment of a thermal sprayer nozzle that is capable of forming coating layers having a range of different average surface roughness; and FIG. 4 is a partial sectional side view of an embodiment of a substrate processing chamber.

DESCRIPTION

Figure 1:
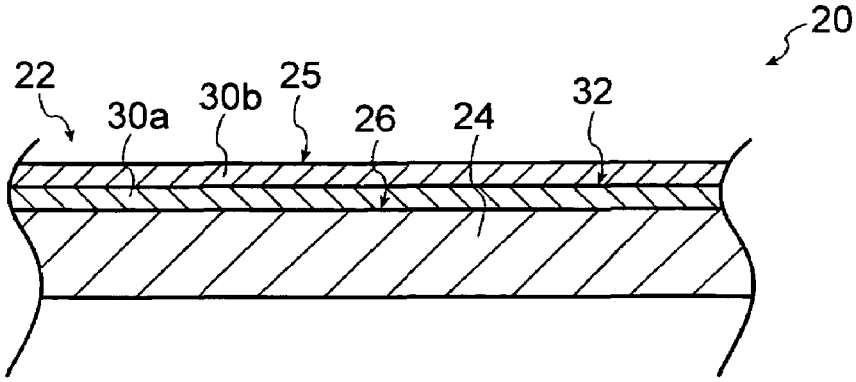
FIG. 1 is a partial sectional side view of an embodiment of a process chamber component having first and second coating layers.

A component 20 suitable for use in a substrate processing chamber is shown in FIG. 1. The component 20 comprises a coating 22 having a textured surface 25 to which process residues can adhere, and which also inhibits erosion of the underlying component. The component 20 having the coating 22 can be a component in the chamber 106 that is susceptible to erosion and/or a build up of process deposits, such as for example, a portion of one or more of a gas delivery system 112 that provides process gas in the chamber 106, a substrate support 114 that supports the substrate 104 in the chamber 106, a gas energizer 116 that energizes the process gas, chamber enclosure walls 118 and shields 120, and a gas exhaust 122 that exhausts gas from the chamber 106, exemplary embodiments of all of which are shown in FIG. 4. For example, in a physical vapor deposition chamber 106, the coated components can comprise any of a chamber enclosure wall 118, a chamber shield 120, a target 124, a cover ring 126, a deposition ring 128, a support ring 130, insulator ring 132, a coil 135, coil support 137, shutter disk 133, clamp shield 141, and a surface 134 of the substrate support 114.

The chamber component 20 comprises an underlying structure 24 having an overlying coating 22 that covers at least a portion of the structure 24, as shown in FIG. 1. The underlying structure 24 comprises a material that is resistant to erosion from an energized gas, such as an energized gas formed in a substrate processing environment. For example, the structure 24 can comprise a metal, such as at least one of aluminum, titanium, tantalum, stainless steel, copper and chromium. In one version, a structure 24 comprising improved corrosion resistance comprises at least one of aluminum, titanium and stainless steel. The structure 24 can also comprise a ceramic material, such as for example at least one of alumina, silica, zirconia, silicon nitride and aluminum nitride. A surface 26 of the structure 24 contacts the coating 22, and desirably has a surface roughness that improves adhesion of the overlying coating 22 to the structure 24. For example, the surface 26 can have a surface roughness of at least about 2.0 micrometers (80 microinches.)

It has been discovered substrate processing can be improved by providing a coating 22 comprising at least two coating layers 30*a,b* of coating material. The multi-layer coating 22 comprises coating layers 30*a,b* having characteristics that are selected to provide good bonding of the coating 22 to the underlying structure 24, while also improving the adhesion of process residues. Desirably the coating 22 comprises a first layer 30*a* that is formed over at least a portion of the surface 26 of the underlying structure 24, and a second layer 30*b* that is formed over at least a portion of the first layer. Suitable materials for at least one of the first and second layers 30*a,b* may comprise, for example, a metal material, such as at least one of aluminum, copper, stainless steel, tungsten, titanium and nickel. At least one of the first and second layers 30*a,b* may also comprise a ceramic material, such as for example at least one of aluminum oxide, silicon oxide, silicon carbide, boron carbide and aluminum nitride. In one version, the coating 22 comprises one or more layers 30*a,b* of aluminum formed over an underlying structure 24 comprising at least one of stainless steel and alumina. While the coating 22 can consist of only two layers 30*a,b*, the coating 22 can also comprise multiple layers of material that provide improved processing characteristics.

The coating 22 desirably comprises a first layer 30*a* having characteristics that provide enhanced bonding to the surface 26 of the underlying structure 24. In one version, improved results are provided with a first layer 30*a* having a textured surface 32 with a first average surface roughness that is sufficiently low to provide good bonding of the first layer 30*a* to the surface 26 of the underlying structure 24. The roughness average of a surface is the mean of the absolute values of the displacements from the mean line of the peaks and valleys of the roughened features along the surface. The first layer 30*s* having the lower surface roughness exhibits good bonding characteristics, such as better contact area between the layer 30 and the underlying surface 26. The lower surface roughness first layer 30*a* also typically has a reduced porosity, which can improve bonding to the underlying surface 26 by reducing the number of voids and pores at the bonding interface. A suitable first layer 30*a* may comprise a surface 32 having a surface roughness average of, for example, less than about 25 micrometers (1000 microinches), such as from about 15 micrometers (600 microinches) to about 23 micrometers (900 microinches), and even about 20 micrometers (800 microinches.) A suitable porosity of the first layer 30*a* may be less than about 10% by volume, such as from about 5% to about 9% by volume. A thickness of the first layer 30*a* can be selected to provide good adhesion to the underlying surface 26 while providing good resistance to erosion, and may be for example from about 0.10 mm to about 0.25 mm, such as from to about 0.15 mm to about 0.20 mm.

The coating 22 further comprises a second coating layer 30*b* formed over at least a portion of the first layer 30*a* that has an exposed textured surface 25 that provides improved adhesion of process residues. For example, the second coating layer 30*b* may comprise a exposed textured surface 25 having a surface roughness average that is greater than that of the first layer 30*b*. The higher surface roughness average of the exposed second layer surface 30*b* enhances the adhesion of process residues to the exposed surface, to reduce the incidence of flaking or spalling of material from the exposed textured surface 25, and inhibit the contamination of substrates 104 being processed with the component 20. A surface roughness average of the exposed textured surface 25 that may be suitable to provide improved adhesion of process residues may be a surface roughness average of at least about 50 micrometers (2000 microinches), and even at least about 56 micrometers (2200 microinches), such as from about 56 micrometers (2200 microinches) to about 66 micrometers (2600 microinches). The second layer 30*b* having the increased surface roughness may also have an increased porosity level that is greater than that of the first coating layer 30*a*, such as a porosity of at least about 12% by volume, such as from about 12% to about 25% by volume, and even at least about 15% by volume. A thickness of the second layer 30*b* that is sufficient to provide good adhesion of the second layer 30*b* to the surface 32 of the first layer 30*a*, while maintaining good resistance to erosion by energized gases, may be from about 0.15 mm to about 0.30 mm, such as from about 0.20 mm to about 0.25 mm.

The coating 22 comprising the first and second layers 30*a,b* provides substantial improvements in the bonding of the coating 22 to the underlying structure 24, as well as in the adhesion of residues to the coating 22. The first layer 30*a* comprising the first lower surface roughness average is capable of forming a strong bond with the surface 26 of the underlying structure 24, and thus anchors the coating 22 to the underlying structure 24. The second layer 30*b* comprising the second higher average surface roughness is capable of accumulating and holding a larger volume of process residues than surfaces having lower average surface roughness, and thus improves the process capability of components 20 having the coating 22. Accordingly, the coating 22 having the first and second coating layers 22 provides improved performance in the processing of substrates, with reduced spalling of the coating 22 from the structure 24, and reduced contamination of processed substrates 104.

In one version, the first and second coating layers 30*a,b* desirably comprise compositions of materials that enhance bonding between the two layers 30*a,b*. For example, the first and second coating layers 30*a,b* may be composed of materials having substantially similar thermal expansion coefficients, such as thermal expansion coefficients that differ by less than about 5%, to reduce spalling of the layers 30*a,b* resulting from thermal expansion mismatch. In a preferred version, the first and second layers 30*a,b* comprise the same composition, to provide optimum adhesion and thermal matching of the first and second layers 30*a,b*. For example, the first and second layers 30*a,b* can composed of aluminum. Because first and second layers 30*a,b* comprising the same material have properties that are well-matched to one another, and respond similarly to different stresses in the processing environment, a second layer with a higher average surface roughness can be provided while still maintaining good adhesion of the second layer to the first layer.

The surface roughness average of the first and second layers 30*a,b* may be determined by a profilometer that passes a needle over the surfaces 32,25 respectively, and generates a trace of the fluctuations of the height of the asperities on the surfaces, or by a scanning electron microscope that uses an electron beam reflected from the surfaces to generate an image of the surfaces. In measuring properties of the surface such as roughness average or other characteristics, the international standard ANSI/ASME B.46.1-1995 specifying appropriate cut-off lengths and evaluation lengths, can be used. The following Table I shows the correspondence between values of roughness average, appropriate cut-off length, and minimum and typical evaluation length as defined by this standard:

TABLE I

| Roughness Average | Cut-off Length | Min. Evaluation Length | Typ. Evaluation Length |
|---|---|---|---|
| 0 to 0.8 microinches (0 to 0.02μ) | 0.003 inches (0.08 mm) | 0.016 inches (0.41 mm) | 0.016 inches (0.41 mm) |
| 0.8 to 4 microinches (0.02μ to 0.1μ) | 0.010 inches (0.25 mm) | 0.050 inches (1.3 mm) | 0.050 inches (1.3 mm) |
| 4 to 80 microinches (0.1μ to 2μ) | 0.030 inches (0.76 mm) | 0.160 inches (4.1 mm) | 0.160 inches (4.1 mm) |
| 80 to 400 microinches (2μ to 10μ) | 0.100 inches (2.5 mm) | 0.300 inches (7.6 mm) | 0.500 inches (13 mm) |
| 400 microinches and above (10μ and above) | 0.300 inches (7.6 mm) | 0.900 inches (23 mm) | 1.600 inches (41 mm) |

The coating 22 comprising the first and second layers 30*a,b* provides improved results over coatings having just a single layer, as the coating exhibits enhanced adhesion of process residues and can more strongly bond to the underlying structure. For example, the coating 22 comprising a first layer 30*a* having a surface roughness average of less than about 25 micrometers (1000 microinches), and a second layer 30*b* having a surface roughness average of greater than about 51 micrometers (2000 microinches) may be capable of being used to process substrates 104 for at least about 200 RF-hours, substantially without contamination of the substrates. In contrast, a conventional single layer coating may be capable of processing substrates 104 for fewer than about 100 RF-hours, before cleaning of the component is required to prevent contaminating the substrates.

The coating layers 30*a,b* are applied by a method that provides a strong bond between the coating 22 and the underlying structure 24 to protect the underlying structure 24. For example, one or more of the coating layers 30*a,b* may be applied by a thermal spraying process, such one or more of a twin-wire arc spraying process, flame spraying process, plasma arc spraying process, and oxy-fuel gas flame spraying process. Alternatively or additionally to a thermal spraying process, one or more of the coating layers can be formed by a chemical or physical deposition process. In one version, the surface 26 of the underlying structure 24 is bead blasted before deposition of the layers 30*a,b* to improve the adhesion of the subsequently applied coating 22 by removing any loose particles from the surface 26, and to provide an optimum surface texture to bond to the first layer 30*a*. The bead blasted surface 26 can be cleaned to remove bead particles, and can be dried to evaporate any moisture remaining on the surface 26 to provide good adhesion of the coating layers 30*a,b*.

Figure 2:
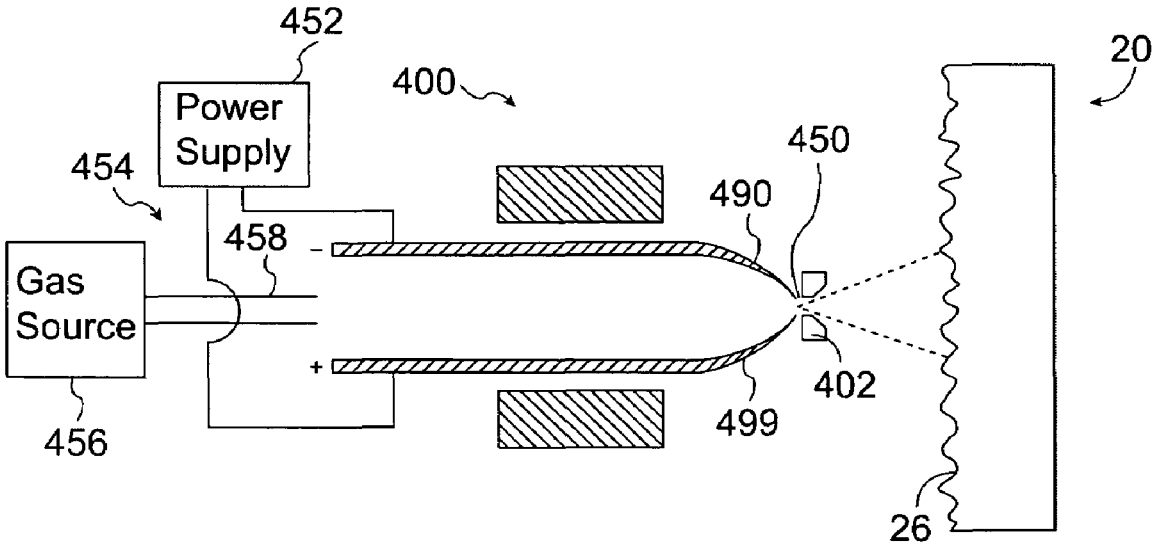
FIG. 2 is a partial schematic view of an embodiment of a thermal sprayer capable of forming a coating on a component.

In one version, the first and second coating layers 30*a,b* are applied to the component 20 by a twin wire arc spray process, as for example described in U.S. Pat. No. 6,227,435 B1, issued on May 8, 2001 to Lazarz et al, and U.S. Pat. No. 5,695,825 issued on Dec. 9, 1997 to Scruggs, both of which are incorporated herein by reference in their entireties. In the twin wire arc thermal spraying process, a thermal sprayer 400 comprises two consumable electrodes 490,499 that are shaped and angled to allow an electric arc to form in an arcing zone 450 therebetween, as shown for example in FIG. 2. For example, the consumable electrodes 490,499 may comprise twin wires formed from the metal to be coated on the surface 22 of the component 20, which are angled towards each other to allow an electric discharge to form near the closest point. An electric arc discharge is generated between the consumable electrodes 490,499 when a voltage, for example from an electrical power supply 452, is applied to the consumable electrodes 490,499 while a carrier gas, such as one or more of air, nitrogen or argon, is flowed between the electrodes 490, 499. The carrier gas can be provided by a gas supply 454 comprising a source 456 of pressurized gas and a conduit 458 or other directing means to direct the pressurized gas past the electrodes 490,499. Arcing between the electrodes 490,499 atomizes and at least partially liquefies the metal on the electrodes 490,499, and carrier gas energized by the arcing electrodes 490,499 propels the molten particles out of the thermal sprayer 400 and towards the surface 26 of the component 20. The molten particles impinge on the surface of the component, where they cool and condense to form a conformal coating layer 30*a,b*. The consumable electrodes 490,499, such as a consumable wire, may be continuously fed into the thermal sprayer to provide a continuous supply of the metal material.

Operating parameters during thermal spraying are selected to be suitable to adjust the characteristics of the coating material application, such as the temperature and velocity of the coating material as it traverses the path from the thermal sprayer to the component. For example, carrier gas flow rates, carrier gas pressures, power levels, wire feed rate, standoff distance from the thermal sprayer to the surface 26, and the angle of deposition of the coating material relative to the surface 26 can be selected to improve the application of the coating material and the subsequent adherence of the coating 22 to the underlying structure surface 26. For example, the voltage between the consumable electrodes 490,499 may be selected to be from about 10 Volts to about 50 Volts, such as about 30 Volts. Additionally, the current that flows between the consumable electrodes 490,499 may be selected to be from about 100 Amps to about 1000 Amps, such as about 200 Amps. The power level of the thermal sprayer is usually in the range of from about 6 to about 80 kiloWatts, such as about 10 kiloWatts.

The standoff distance and angle of deposition can also be selected to adjust the deposition characteristics of the coating material on the surface 26. For example, the standoff distance and angle of deposition can be adjusted to modify the pattern in which the molten coating material splatters upon impacting the surface, to form for example, "pancake" and "lamella" patterns. The standoff distance and angle of deposition can also be adjusted to modify the phase, velocity, or droplet size of the coating material when it impacts the surface 26. In one embodiment, the standoff distance between the thermal sprayer 400 and the surface is about 15 cm, and the angle of deposition of the coating material onto the surface 26 is about 90 degrees.

The velocity of the coating material can be adjusted to suitably deposit the coating material on the surface 26. In one embodiment, the velocity of the powdered coating material is from about 100 to about 300 meters/second. Also, the thermal sprayer 400 may be adapted so that the temperature of the coating material is at least about melting temperature when the coating material impacts the surface. Temperatures above the melting point can yield a coating of high density and bonding strength. For example, the temperature of the energized carrier gas about the electric discharge may exceed 5000° C. However, the temperature of the energized carrier gas about the electric discharge can also be set to be sufficiently low that the coating material remains molten for a period of time upon impact with the surface 26. For example, an appropriate period of time may be at least about a few seconds.

The thermal spraying process parameters are desirably selected to provide a coating 22 with layers 30*a,b* having the desired structure and surface characteristics, such as for example a desired coating thickness, coating surface roughness, and the porosity of the coating, which contribute to the improved performance of the coated components 20. In one version, a coating 22 is formed by maintaining first thermal spraying process parameters during a first step to form the first layer 30*a* and changing the thermal spraying process parameters to a second parameter set during a second step to form the second layer 30*b* having the higher surface roughness average. For example, the first thermal spraying process parameters may be those suitable for forming a first layer 30*a* having a surface 32 with a lower average surface roughness, while the second thermal spraying process parameters may be those suitable for forming a second layer 30*b* having a surface 32 with a higher average surface roughness.

In one version, the first thermal spraying process parameters for depositing the first layer 30*a* comprise a relatively high first pressure of the carrier gas, and the second thermal spraying process parameters for depositing the second layer 30*b* comprise a relatively low second pressure of the carrier gas that is less than the first pressure. For example, a first pressure of the carrier gas that is maintained during the deposition of the first layer 30*a* of may be at least about 200 kilopascals (30 pounds-per-square-inch), such as from about 275 kPa (40 PSI) to about 415 kPa (60 PSI). It is believed that a higher pressure of the carrier gas may result in closer packing of the sprayed coating material on the structure surface 26, thus providing a lower average surface roughness of the resulting layer. A second pressure of the carrier gas that is maintained during the deposition of the second layer 30*b* may be at less than about 200 kPa (30 PSI), and even less than about 175 kPa (25 PSI) such as from about 100 kPa (15 PSI) to about 175 kPa (25 PSI.) Other parameters can also be varied between the deposition of the first and second layers 30*a,b* to provide the desired layer properties.

In one version, a first thermal spraying process to deposit a first aluminum layer 30*a* comprises maintaining a first pressure of the carrier gas of about 415 kPa (60 PSI), while applying a power level to the electrodes 490,499 of about 10 Watts. A standoff distance from the surface 26 of the underlying structure 24 is maintained at about 15 cm (6 inches), and a deposition angle to the surface 26 is maintained at about 90°. A second thermal spraying process to deposit a second aluminum layer 30*b* comprises maintaining a second pressure of the carrier gas at the lower pressure of about 175 kPa (25 PSI), while applying a power level to the electrodes 490,499 of about 10 Watts. A standoff distance from the surface 32 of the first aluminum layer 30*a* is maintained at about 15 cm (6 inches), and a deposition angle to the surface 32 is maintained at about 90°.

In accordance with the principles of the invention, an improved thermal sprayer 400 has been developed that provides for the formation of both the first and second layers 30*a,b* having the higher and lower surface roughness averages with the same thermal sprayer 400. In one version, the improved thermal sprayer 400 comprises an improved nozzle 402, an embodiment of which is shown in FIGS. 3*a* and 3*b*. The improved nozzle comprises a conduit 404 that receives pressurized gas and molten coating particles, and a conical section 406 that releases the pressurized gas and molten particles from the thermal sprayer 400 to spray the molten coating material onto the component structure. The conduit 404 comprises an inlet 403 to receive the pressurized gas and coating particles that is flowed into the conduit from the electrical arcing zone. The conical section 406 comprises an inlet 405 that receives the pressurized gas and coating particles from the conduit 404, and has an outlet 407 that releases the gas and molten coating particles from the nozzle 402.

The walls of the conical section 406 comprise sloping conical sidewalls 408 that expand outwardly about a central axis 409 of the conical section 406 from a first diameter $d_1$ at the conical section inlet 405, to a second diameter $d_2$ at the conical section outlet 407. The sloping conical sidewalls 408 provide a conical flow path through the section, with a narrower flow path at the inlet 405 that gradually increases to a wider flow path at the outlet 407. For example, the conical sidewalls 408 may comprise a first diameter of from about 5 mm to about 23 mm, such as from about 10 mm to about 23 mm, and even from about 10 mm to about 15 mm. A second diameter may be from about 20 mm to about 35 mm, such as from about 23 mm to about 25 mm. A preferred second diameter of the outlet 407 may be for example, at least about 1.5 times the size of first diameter the inlet 405, such as from about 1.5 times to about 2 times the size of the inlet diameter. The sloping conical sidewalls 408 form an angle $\alpha$ with respect to one another of from about 60° to about 120°, such as about 90°.

The improved nozzle 402 is capable of passing pressurized gas and molten coating particles pass therethrough to provide for the deposition of coating layers 30*a,b* having a range of surface roughness averages. The first diameter $d_1$ of the conical section inlet 405 can be selected according to the minimum and maximum surface roughness desired of the first and second layers 30*a,b*, with a smaller first diameter favoring a range of relatively lower average surface roughness, and a higher first diameter promoting a range of relatively higher average surface roughness. The second diameter $d_2$ can be sized to provide the desired spread and distribution of the sprayed coating material to provide the desired coating properties. The spraying process parameters are then selected to provide the desired average surface roughness. For example, a relatively high pressure of the carrier gas may be provided to form a layer 30*a* having a relatively low average surface roughness, whereas a relatively low pressure of the carrier gas may be provided to form a layer 30*b* having a relatively high average surface roughness. A higher pressure of the gas is believed to cause the molten coating material to pack together more tightly and homogeneously on the surface of the component structure to yield a lower surface roughness structure, due at least in part to the high feed rate of the coating material. A lower pressure yields lower feed rates, and thus results in a coating structure having a higher porosity and higher average surface roughness. The improved nozzle 402 allows for the efficient fabrication of layers 30*a,b* having different average surface roughness on the component 20 while also allowing for desired spraying properties, such as the spread and distribution of the coating particles, substantially without requiring separate apparatus components for each layer 30*a,b*, or the re-setting of numerous spraying parameters.

Once the coating 22 has been applied, the surface 25 of the coating 22 may be cleaned of any loose coating particles or other contaminants. The surface 25 can be cleaned with a cleaning fluid, such as at least one of water, an acidic cleaning solution, and a basic cleaning solution, and optionally by ultrasonically agitating the component 20. In one version, the surface 25 is cleaned by rinsing with de-ionized water.

The coated component 20 can also be cleaned and refurbished after processing one or more substrates 104, to remove accumulated process residues and eroded portions of the coating 22 from the component 20. In one version, the component 20 can be refurbished by removing the coating 22 and process residues, and by performing various cleaning processes to clean the underlying surface 26 before re-applying the coating layers 30*a,b*. Cleaning the underlying surface 26 provides enhanced bonding between the underlying structure 24 and a subsequently re-formed coating 22. Once the underlying structure has been cleaned, for example by a cleaning method described in U.S. application Ser. No. 10/833,975 to Lin et al, filed on Apr. 27, 2004, and commonly assigned to Applied Materials, which is herein incorporated by reference in its entirety, the coating 22 can be re-formed over the surface 26 of the underlying structure 24.

An example of a suitable process chamber 106 having a component with coating layers 30*a,b* is shown in FIG. 4. The chamber 106 can be a part of a multi-chamber platform (not shown) having a cluster of interconnected chambers connected by a robot arm mechanism that transfers substrates 104 between the chambers 106. In the version shown, the process chamber 106 comprises a sputter deposition chamber, also called a physical vapor deposition or PVD chamber, that is capable of sputter depositing material on a substrate 104, such as one or more of tantalum, tantalum nitride, titanium, titanium nitride, copper, tungsten, tungsten nitride and aluminum. The chamber 106 comprises enclosure walls 118 that enclose a process zone 109, and that include sidewalls 164, a bottom wall 166, and a ceiling 168. A support ring 130 can be arranged between the sidewalls 164 and ceiling 168 to support the ceiling 168. Other chamber walls can include one or more shields 120 that shield the enclosure walls 118 from the sputtering environment.

The chamber 106 comprises a substrate support 130 to support the substrate in the sputter deposition chamber 106. The substrate support 130 may be electrically floating or may comprise an electrode 170 that is biased by a power supply 172, such as an RF power supply. The substrate support 130 can also comprise a shutter disk 133 that can protect the upper surface 134 of the support 130 when the substrate 104 is not present. In operation, the substrate 104 is introduced into the chamber 106 through a substrate loading inlet (not shown) in a sidewall 164 of the chamber 106 and placed on the support 130. The support 130 can be lifted or lowered by support lift bellows and a lift finger assembly (not shown) can be used to lift and lower the substrate onto the support 130 during transport of the substrate 104 into and out of the chamber 106.

The support 130 may also comprise one or more rings, such as a cover ring 126 and a deposition ring 128, that cover at least a portion of the upper surface 134 of the support 130 to inhibit erosion of the support 130. In one version, the deposition ring 128 at least partially surrounds the substrate 104 to protect portions of the support 130 not covered by the substrate 104. The cover ring 126 encircles and covers at least a portion of the deposition ring 128, and reduces the deposition of particles onto both the deposition ring 128 and the underlying support 130.

A process gas, such as a sputtering gas, is introduced into the chamber 106 through a gas delivery system 112 that includes a process gas supply comprising one or more gas sources 174 that each feed a conduit 176 having a gas flow control valve 178, such as a mass flow controller, to pass a set flow rate of the gas therethrough. The conduits 176 can feed the gases to a mixing manifold (not shown) in which the gases are mixed to from a desired process gas composition. The mixing manifold feeds a gas distributor 180 having one or more gas outlets 182 in the chamber 106. The process gas may comprise a non-reactive gas, such as argon or xenon, which is capable of energetically impinging upon and sputtering material from a target. The process gas may also comprise a reactive gas, such as one or more of an oxygen-containing gas and a nitrogen-containing gas, that are capable of reacting with the sputtered material to form a layer on the substrate 104. Spent process gas and byproducts are exhausted from the chamber 106 through an exhaust 122 which includes one or more exhaust ports 184 that receive spent process gas and pass the spent gas to an exhaust conduit 186 in which there is a throttle valve 188 to control the pressure of the gas in the chamber 106. The exhaust conduit 186 feeds one or more exhaust pumps 190. Typically, the pressure of the sputtering gas in the chamber 106 is set to sub-atmospheric levels.

The sputtering chamber 106 further comprises a sputtering target 124 facing a surface 105 of the substrate 104, and comprising material to be sputtered onto the substrate 104. The target 124 is electrically isolated from the chamber 106 by an annular insulator ring 132, and is connected to a power supply 192. The sputtering chamber 106 also has a shield 120 to protect a wall 118 of the chamber 106 from sputtered material. The shield 120 can comprise a wall-like cylindrical shape having upper and lower shield sections 120*a*, 120*b* that shield the upper and lower regions of the chamber 106. In the version shown in FIG. 4, the shield 120 has an upper section 120*a* mounted to the support ring 130 and a lower section 120*b* that is fitted to the cover ring 126. A clamp shield 141 comprising a clamping ring can also be provided to clamp the upper and lower shield sections 120*a,b* together. Alternative shield configurations, such as inner and outer shields, can also be provided. In one version, one or more of the power supply 192, target 124, and shield 120, operate as a gas energizer 116 that is capable of energizing the sputtering gas to sputter material from the target 124. The power supply 192 applies a bias voltage to the target 124 with respect to the shield 120. The electric field generated in the chamber 106 from the applied voltage energizes the sputtering gas to form a plasma that energetically impinges upon and bombards the target 124 to sputter material off the target 124 and onto the substrate 104. The support 130 having the electrode 170 and support electrode power supply 172 may also operate as part of the gas energizer 116 by energizing and accelerating ionized material sputtered from the target 124 towards the substrate 104. Furthermore, a gas energizing coil 135 can be provided that is powered by a power supply 192 and that is positioned within the chamber 106 to provide enhanced energized gas characteristics, such as improved energized gas density. The gas energizing coil 135 can be supported by a coil support 137 that is attached to a shield 120 or other wall in the chamber 106.

The chamber 106 is controlled by a controller 194 that comprises program code having instruction sets to operate components of the chamber 106 to process substrates 104 in the chamber 106. For example, the controller 194 can comprise a substrate positioning instruction set to operate one or more of the substrate support 130 and substrate transport to position a substrate 104 in the chamber 106; a gas flow control instruction set to operate the flow control valves 178 to set a flow of sputtering gas to the chamber 106; a gas pressure control instruction set to operate the exhaust throttle valve 188 to maintain a pressure in the chamber 106; a gas energizer control instruction set to operate the gas energizer 116 to set a gas energizing power level; a temperature control instruction set to control temperatures in the chamber 106; and a process monitoring instruction set to monitor the process in the chamber 106.

Although exemplary embodiments of the present invention are shown and described, those of ordinary skill in the art may devise other embodiments which incorporate the present invention, and which are also within the scope of the present invention. For example, other chamber components than the exemplary components described herein can also be cleaned. Other thermal sprayer 400 configurations and embodiments can also be used, and coating and structure compositions other than those described can be used. Additional cleaning steps other than those described could also be performed, and the cleaning steps could be performed in an order other than that described. Furthermore, relative or positional terms shown with respect to the exemplary embodiments are interchangeable. Therefore, the appended claims should not be limited to the descriptions of the preferred versions, materials, or spatial arrangements described herein to illustrate the invention.

What is claimed is:

1. A substrate processing chamber component capable of being exposed to an energized gas in a process chamber, the component comprising:

(a) an underlying structure;

(b) a first coating layer over the underlying structure, the first coating layer comprising (i) a porosity of less than about 10%, and (ii) a first surface with an average surface roughness of less than about 25 micrometers; and (c) a second coating layer over the first coating layer, the second coating layer comprising (i) a porosity of at least about 12%. and (ii) a second surface with an average surface roughness of at least about 50 micrometers, whereby process residues adhere to the second surface to reduce the contamination of processed substrates.

2. A component according to claim 1 wherein the first and second coating layers comprise sprayed aluminum coating layers.

3. A component according to claim 2 wherein the underlying structure comprises at least one of aluminum, titanium, tantalum, stainless steel, copper and chromium.

4. A component according to claim 1 wherein the second coating layer comprises a porosity of at least about 15%.

5. A component according to claim 1 wherein the first coating layer comprises a thickness of from about 0.1 mm to about 0.25 mm, and the second coating layer comprises a thickness of from about 0.15 mm to about 0.3 mm.

6. A component according to claim 1 wherein the component comprises at least a portion of at least one of a chamber enclosure wall, shield, process kit, substrate support, gas delivery system, gas energizer, and gas exhaust.

7. A substrate process chamber comprising the component of claim 1, the chamber comprising a substrate support, gas delivery system, gas energizer and gas exhaust.

8. A component according to claim 1 wherein the underlying structure comprises a ceramic material.

9. A component according to claim 8 wherein the underlying structure comprises at least one of alumina, silica, zirconia, silicon nitride and aluminum nitride.

10. A component according to claim 1 wherein the surface of the underlying structure comprises a surface roughness of at least about 80 microinches.

11. A component according to claim 1 wherein at least one of the first and second layers comprises a metal.

12. A component according to claim 1 wherein the metal comprises at least one of copper, stainless steel, tungsten, titanium and nickel.

13. A component according to claim 1 wherein at least one of the first and second layers comprises a ceramic material.

14. A component according to claim 1 wherein the ceramic material comprises at least one of aluminum oxide, silicon oxide, silicon carbide, boron carbide and aluminum nitride.

15. A component according to claim 1 wherein the first and second layers comprise aluminum, and wherein the underlying structure comprises at least one of stainless steel and alumina.

16. A component according to claim 1 wherein the first and second coating layers are composed of materials having thermal expansion coefficients that differ by less than about 5%.

17. A component according to claim 1 wherein the first and second sprayed layers are applied by a thermal spraying process.

18. A component according to claim 1 wherein the thermal spraying process comprises twin-wire arc spraying process, flame spraying process, plasma arc spraying process, and oxy-fuel gas flame spraying process.

19. A component according to claim 1 wherein component comprises a substrate support.

20. A component according to claim 1 wherein substrate support comprises a shutter disk.

21. A component according to claim 1 wherein component comprises at least one of a cover ring, deposition ring, support ring or insulator ring.

22. A component according to claim 1 wherein the deposition ring at least partially surrounds a substrate held on a support, and the cover ring encircles and covers at least a portion of the deposition ring.

23. A component according to claim 1 wherein component comprises a coil or coil support.

24. A component according to claim 1 wherein component comprises a shield.

25. A component according to claim 1 wherein component comprises a clamp shield.

26. A component according to claim 1 wherein component comprises at least one of a sidewall, bottom wall, or ceiling of a process chamber.

27. A component according to claim 1 wherein component comprises a target.

28. A substrate processing chamber component capable of being exposed to an energized gas in a process chamber, the component comprising:

(a) an underlying structure comprising at least one of aluminum, stainless steel, and titanium;

(b) a first sprayed coating layer of aluminum over the underlying structure, the first sprayed coating layer having (i) a porosity of less than about 10%, and (ii) a first surface with an average surface roughness of less than about 25 micrometers; and (c) a second sprayed coating layer of aluminum over the first sprayed coating layer, the second sprayed coating layer having (i) a porosity of at least about 12%, and (ii) a second surface with an average surface roughness of at least about 50 micrometers, whereby process residues adhere to the second surface to reduce the contamination of processed substrates.

29. A component according to claim 28 wherein the first sprayed coating layer comprises an average surface roughness of from about 15 micrometers to about 23 micrometers, and wherein the second sprayed coating layer comprises an average surface roughness of from about 56 micrometers to about 66 micrometers and has a porosity of at least about 15%.

30. A substrate processing chamber component comprising:

(a) an underlying structure comprising at least one of aluminum, stainless steel, and titanium;

(b) a first sprayed coating layer over the underlying structure, the first layer comprising (i) aluminum, (ii) a porosity of less than about 10%, and (iii) an average surface roughness of from about 15 micrometers to about 23 micrometers; and (c) a second sprayed coating layer the first sprayed coating layer, the second layer comprising (i) aluminum, (ii) a porosity of at least about 15%, and (iii) an average surface roughness of from about 56 micrometers to about 66 micrometers.

31. A component according to claim 30 wherein the first sprayed coating layer comprises a thickness of from about 0.1 mm to about 0.25 mm, and the second sprayed coating layer comprises a thickness of from about 0.15 mm to about 0.3 mm.

32. A component according to claim 30 wherein the component comprises at least a portion of at least one of a chamber enclosure wall, shield, process kit, substrate support, gas delivery system, gas energizer, and gas exhaust.

33. A substrate process chamber comprising the component of claim 30, the chamber comprising a substrate support, gas delivery system, gas energizer and gas exhaust.

* * * * *